US008955525B2

(12) United States Patent
Tiram

(10) Patent No.: US 8,955,525 B2
(45) Date of Patent: Feb. 17, 2015

(54) HAIR TREATING APPARATUS AND METHOD OF USING THE APPARATUS

(71) Applicant: Aaron Tiram, Lincolnwood, IL (US)

(72) Inventor: Aaron Tiram, Lincolnwood, IL (US)

( * ) Notice: Subject to any disclaimer, the term of this patent is extended or adjusted under 35 U.S.C. 154(b) by 0 days.

(21) Appl. No.: 13/898,575

(22) Filed: May 21, 2013

(65) Prior Publication Data

US 2014/0345638 A1 Nov. 27, 2014

(51) Int. Cl.
*A45D 24/22* (2006.01)
*A45D 24/02* (2006.01)
*A45D 24/00* (2006.01)

(52) U.S. Cl.
CPC ..... *A45D 24/22* (2013.01); *A45D 24/02* (2013.01); *A45D 24/00* (2013.01)
USPC ..... 132/112

(58) Field of Classification Search
CPC ..... A45D 24/22; A45D 24/00; A45D 24/02
USPC ..... 132/208, 112, 270
See application file for complete search history.

(56) References Cited

U.S. PATENT DOCUMENTS 1,847,401 A * 3/1932 Klein ..... 132/148
2,041,262 A * 5/1936 Ness ..... 15/188
2,252,551 A * 8/1941 Brollier et al. ..... 15/104.94
3,608,565 A * 9/1971 Ensign ..... 132/212
3,640,290 A * 2/1972 Theis ..... 132/217
2004/0182408 A1* 9/2004 De LaForcade ..... 132/112
2007/0144550 A1* 6/2007 Roher ..... 132/208
2008/0083418 A1* 4/2008 Glenn et al. ..... 132/208
2008/0083420 A1* 4/2008 Glenn et al. ..... 132/208
2008/0223391 A1* 9/2008 Baker et al. ..... 132/202
2009/0071496 A1* 3/2009 Glenn et al. ..... 132/208

* cited by examiner

*Primary Examiner* — Robyn Doan
(74) *Attorney, Agent, or Firm* — Wood, Phillips, Katz, Clark & Mortimer

(57) ABSTRACT

A hair treating apparatus having a first component with opposite first and second sides. The first side is engageable by a first finger on a user's hand. A second component has opposite third and fourth sides. The third side is engageable by a second finger on the user's hand. The hair treating apparatus is operatively positioned with: a) the user's first finger engaging the first side and the user's second finger engaging the third side; and b) an accumulation of elongate hair strands between the second and fourth sides. The first and second components can be manipulated by movement of the user's first and second fingers to cause the second and fourth sides to move selectively towards each other to engage the accumulation of hair strands and away from each other. The operatively positioned hair treating apparatus can be drawn lengthwise of an engaged accumulation of hair strands to thereby controllably apply additive.

18 Claims, 3 Drawing Sheets

HAIR TREATING APPARATUS AND METHOD OF USING THE APPARATUS

BACKGROUND OF THE INVENTION

1. Field of the Invention

This invention relates to hair and, more particularly, to an apparatus for treating hair by controllably applying an additive thereto. The invention is also directed to a method of using the apparatus.

2. Background Art

There is currently a multitude of treatments that are carried out on hair to condition and/or change the appearance thereof. These treatments commonly involve the application of an additive to hair, and commonly at only localized regions thereof.

As one exemplary hair treatment, ends of hair are commonly streaked with a color that contrasts with the remainder of the person's hair. Hair styles that utilize "spikes" often have colored streaks added to the hair tip region.

While such hairstyles have become increasingly more popular, few steps have been taken to improve treatment methods. Preferably, the hair streaking is performed by grasping discrete hair accumulations between a hairdresser's fingers and controllably working in the additive by manipulating the hair. A discrete amount of the additive may be applied to the hair through one or both of the hairdresser's hands.

Regardless of the precise manner of carrying out the method, the hairdresser is required to expose his/her hands to the additive. Hair dyes have a tendency to stain. Plastic gloves, that might be used to shield hands during application, may make it more difficult to control the application of the additive. Further, manipulation of the hair to facilitate even application of the additive may be made more difficult with such gloves being used.

Still further, the need to have such gloves available adds cost to such procedures. Further, gloves must be disposed of and commonly end up as non-biodegradable masses in landfills.

When exposed fingers are used to carry out the treatment, it is also difficult to manipulate the hair in a manner that the additive will be uniformly introduced over the intended treatment length. That is, hair strands at the treatment site may be wrapped, entangled, or simply overlapped in such a manner that additives such as dyes are non-uniformly applied to the hair.

In spite of the increasing popularity of hairstyles that require controlled application of additive, particularly at localized tip regions, the hairdressing industry has continued to use dated techniques, as described above, and has thus contended with the above mentioned, and other, drawbacks.

SUMMARY OF THE INVENTION

In one form, the invention is directed to a hair treating apparatus including: a first component having opposite first and second sides, with the first side engageable by a first finger on a user's hand and the second side configured to accept an additive to be applied to hair; and a second component having opposite third and fourth sides, with the third side engageable by a second finger on the user's hand. The hair treating apparatus is operatively positioned with: a) the user's first finger engaging the first side and the user's second finger engaging the third side; and b) an accumulation of elongate hair strands, each with a length, between the second and fourth sides. The first and second components can be manipulated by movement of the user's first and second fingers at the first and third sides to cause the second and fourth sides to move selectively: i) towards each other to engage the accumulation of hair strands; and ii) away from each other. The operatively positioned hair treating apparatus can be drawn lengthwise of an engaged accumulation of hair strands to thereby controllably apply additive along the lengths of the accumulation of hair strands.

In one form, the second side has a discrete receptacle for receiving a quantity of additive.

In one form, the hair treating apparatus has a quantity of additive in the discrete receptacle. The additive is one of: a) a dye; and b) a conditioner.

In one form, there are bristles on at least one of: a) the second side projecting towards the fourth side; and b) the fourth side projecting towards the second side with the hair treating apparatus operatively positioned.

In one form, the first and second components each has a length and width. The length for each component is greater than its width. The lengths of the first and second components are generally aligned with the hair treating apparatus operatively positioned.

In one form, at least one of the components has a receptacle into which a respective one of the user's first and second fingers can be directed by moving the finger generally parallel to the length of the one component.

In one form, the first and second components are joined by a tether that allows the first and second components to be relatively repositioned so as to move the second and fourth sides selectively towards and away from each other with the hair treating apparatus operatively positioned.

In one form, the tether is in the form of a live hinge.

In one form, the receptacle is defined by a strap connected to the one component at spaced locations.

In one form, the first component has an oval outer perimeter.

In one form, the first and second components have perimeter shapes that are substantially the same.

In one form, there is a first plurality of bristles on the second side projecting towards the fourth side and a second plurality of bristles on the fourth side projecting towards the second side with the hair treating apparatus operatively positioned.

In one form, there is a plurality of bristles on the fourth side that project toward additive at a location where additive is applied to the second side with the hair treating apparatus operatively positioned.

In one form, there is a discrete open receptacle on the second side. A plurality of the bristles project towards the receptacle with the hair treating apparatus operatively positioned.

In one form, there is a plurality of bristles on the second side projecting toward the fourth side with the hair treating apparatus operatively positioned.

In one form, the plurality of bristles on the second side is formed into a ring shape around an opening. A majority of the plurality of bristles on the fourth side reside within the opening with the hair treating apparatus operatively positioned.

In one form, the ring shape is substantially oval with major and minor axes. The receptacle has an elongate shape with a length aligned with the major axis and resides within the opening.

In one form, the invention is directed to a method of treating hair. The method involves the steps of: obtaining a hair treating apparatus as described above; placing an additive on the second side; engaging the first side with a user's first finger and the third side with a user's second finger; operatively positioning the hair treating apparatus by moving the first and second fingers to situate an accumulation of elongate hair strands between the second and fourth sides; and with the hair treating apparatus operatively positioned drawing the hair treating apparatus against the accumulation of hair strands to controllably distribute the additive along lengths of the accumulation of hair strands.

In one form, the hair treating apparatus has a plurality of bristles. The step of drawing the hair treating apparatus involves causing the bristles to comb through the accumulation of hair strands.

In one form, the method of treating hair further includes the step of squeezing the first and second components against each other through the first and second fingers to cause oppositely projecting bristles in the plurality of bristles to project in opposite directions through the accumulation of hair strands.

DETAILED DESCRIPTION OF THE PREFERRED EMBODIMENT

Figure 1:
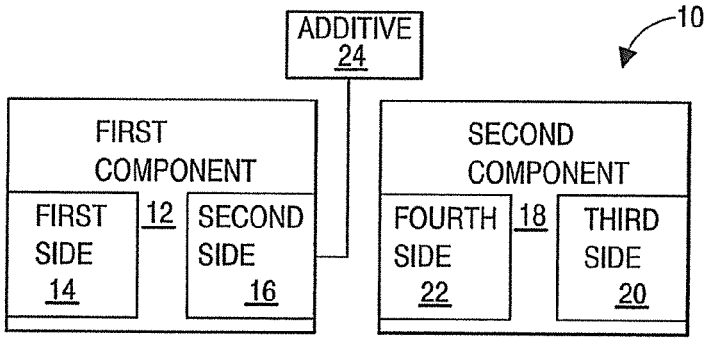
FIG. 1 is a schematic representation of one form of hair treating apparatus according to the present invention.

In FIG. 1, a hair treating apparatus, according to the present invention, is shown at 10. The apparatus 10 is shown in schematic form to identify the basic components contemplated. The schematic showing is intended to encompass the specific embodiments described herein, as well as embodiments with numerous variations of the basic components in FIG. 1, that would be readily devised by one skilled in the art with the inventive principles in hand.

The apparatus 10 consists of a first component 12 having opposite first and second sides 14, 16, respectively. The apparatus 10 further has a second component 18 with opposite third and fourth sides, 20, 22, respectively. The first side 14 is engageable by a first finger on a user's hand, with the third side engageable by a second finger on the user's same hand. The second side 16 is configured to accept an additive 24 to be applied to hair. The additive may be any additive used to treat hair, such as a dye, a conditioner, etc.

The hair treating apparatus is operatively positioned with: a) the user's first finger engaging the first side 14 and the user's second finger engaging the third side 20; and b) an accumulation of hair strands, each with a length, between the second and fourth sides 16, 22. The first and second components 12, 18 can be manipulated by movement of the user's first and second fingers at the first and second sides 14, 16 to cause the second and fourth sides 16, 22 to move selectively: a) towards each other to engage the accumulation of hair strands; and b) away from each other.

With the hair treating apparatus 10 operatively positioned, it can be drawn lengthwise of the engaged accumulation of hair strands to thereby controllably apply additive along the lengths of the hair strands.

One specific form of the apparatus will now be described with respect to FIGS. 2-4, 6 and 7. The hair treating apparatus 10 is shown with the first and second components 12, 18 in the form of blocks. The first component 12 has a length L and a width W. The component 12 has an overall oval shape bounded by a perimeter edge 26 between the first and second sides 14, 16. In one exemplary form, the length L is on the order or 1.5 inches, with the width W on the order of ¾". These dimensions should not be viewed as limiting. The thickness T of the component 12 may be on the order of ¼-½ inch, though again this dimensional range should not be viewed as limiting.

Essentially, the shape and thickness of the first component 12, as well as that of the second component 18, as described below, could be varied considerably from what is depicted so long as they are capable of performing as described herein.

Figure 4:
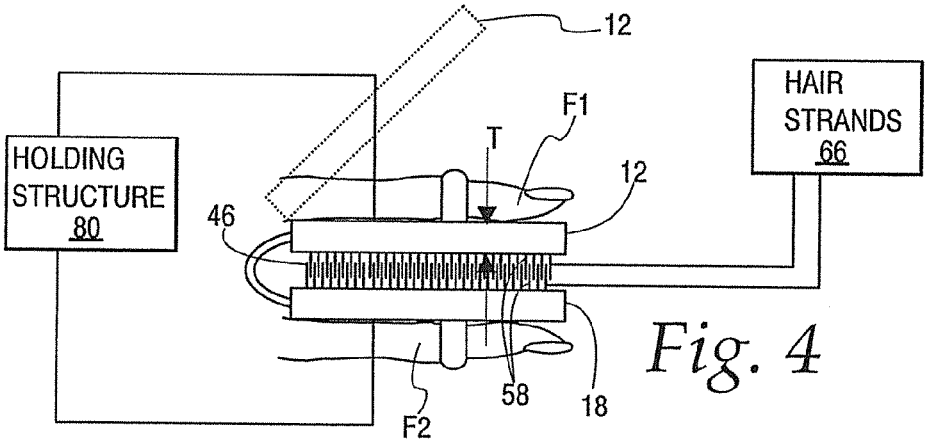
FIG. 4 is a side elevation view of the apparatus operatively positioned and shown in a partially open state in dotted lines.

As described above relative to FIG. 1, the first component 12 has the first side 14, which is engageable by a user's first finger F1, shown in FIG. 4, and the second side 16, which accepts a quantity of the additive 24.

A receptacle 28 is provided for the finger F1. The receptacle 28 is defined by a strap 30 connected to the component 12 at spaced locations 32, 34. The receptacle 28 is located closer to a distal end 36 of the component 12 than a proximal end 38 thereof. With this arrangement, the finger F1 can be directed into the receptacle 28 by sliding along a surface 40 on the first side 14 in a path generally parallel to the length of the component 12 in a direction as indicated by the arrow 42, from the proximal end 38 towards the distal end 36.

The second side 16 has a discrete receptacle 44 formed therein for receiving a quantity of the additive 24. In this embodiment, the receptacle 44 is at all times open. The receptacle 44 has a length aligned with the major axis of the oval shape of the component 12. The width of the receptacle 44 along the minor axis of the oval is significantly less than the width W. The receptacle 44 is centered in a widthwise direction.

A plurality of bristles 46 is arranged in a ring shape around the receptacle 44, with the ring conforming to the oval peripheral edge shape.

The second component 18 has a shape generally the same as that of the first component 12. The component 18 has a perimeter edge 48, substantially matched to the perimeter edge 26, between the third and fourth sides 20, 22.

The component 18 has a proximal end 50 and a distal end 52. A strap 54, that may be the same as the strap 30, is connected so as to define a receptacle 56, corresponding to the receptacle 28, but for the user's second finger F2. The finger F2 is directed into the receptacle 56 in the same way that the finger F1 is directed into the receptacle 28. The second finger F2 resides at the third side 20.

A plurality of bristles 58 is provided on the fourth side 22.

Figure 2:
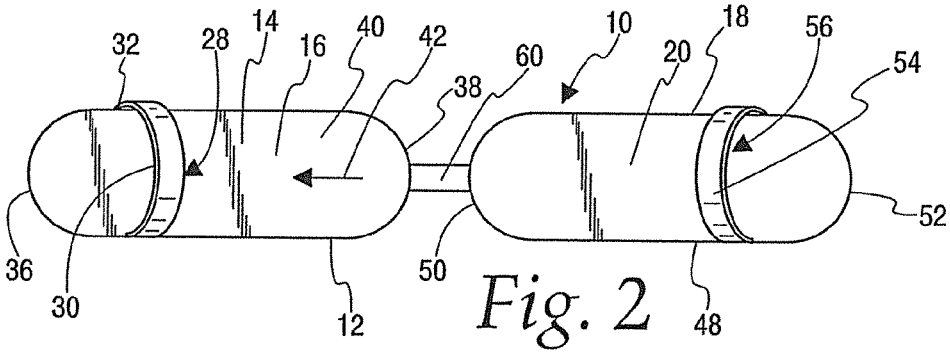
FIG. 2 is a top view of one specific form of hair treating apparatus, as shown at FIG. 1, and with separate components thereon placed in a flattened state.
Figure 3:
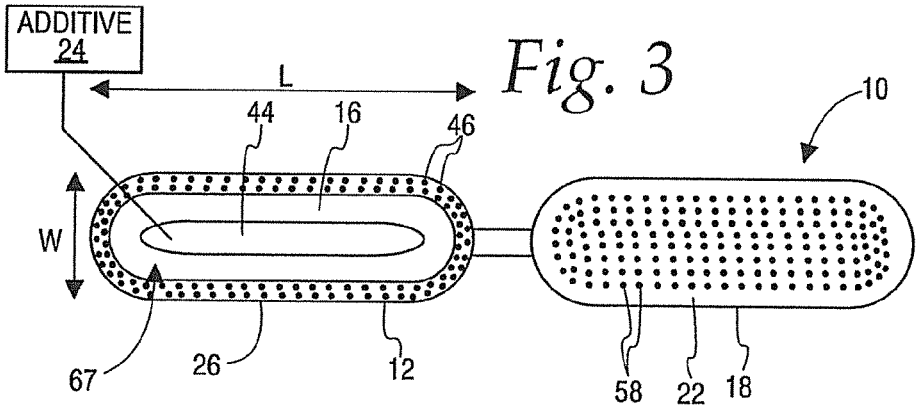
FIG. 3 is a bottom view of the apparatus in the FIG. 2 state.

The first and second components 12, 18 are joined together by a tether 60 that connects at the proximal ends 38, 50 of the components 12, 18. The tether 60 allows the first and second components 12, 18 to be relatively moved between a relationship as shown in FIG. 2 and the operatively positioned relationship as shown in FIG. 4. As the components 12, 18 are moved from the FIG. 2 relationship into the FIG. 4 relationship the second and fourth sides 16, 22 are moved towards each other. By simply moving the fingers F1, F2 towards and away from each other, the components 12, 18 pivot between the FIG. 2 and FIG. 4 relationships.

In this embodiment, the tether 60 is shown in the form of a flexible, live hinge. With the live hinge, the components 12, 18 are normally urged away from each other with a slight parting force. With a relatively light squeezing force applied by the first and second fingers F1, F2, the parting force can be overcome so that the second and fourth sides 16, 22 move selectively towards each other with the hair treating apparatus operatively positioned. Release of this squeezing pressure allows the apparatus to open, as shown in dotted lines in FIG. 4.

Figure 5:
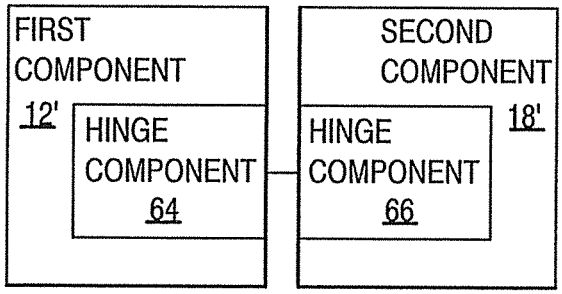
FIG. 5 is a schematic representation of a form of hinge for connecting the separate components that is an alternative to that form shown in FIGS. 2-4.

As an alternative to the live hinge construction, cooperating hinge components 64, 66 may be provided on corresponding first and second components 12', 18', as shown in FIG. 5, to guide relative movement therebetween, as around a substantially fixed axis.

Even with the live hinge arrangement, the width of the tether 60 can be made sufficiently large that there is not a substantial twisting of the components 12, 18 about the length of the tether 60 as the components 12, 18 are relatively moved.

The bristles 46, 58 perform essentially a brushing or combing function so as to separate and untangle the individual hair strands 66 in the accumulation thereof between the components 12, 18, with the hair treating apparatus 10 operatively positioned, as shown generally in FIG. 4. This makes the hair more receptive to an even application of the additive. The bristles 46, 58 tend to work the additive evenly into the engaged hair strands 66.

In this embodiment, the inner row of bristles 46 on the second side 16 extends around and bounds an opening 67 at the second side 16. The outer perimeter row of the bristles 58 on the second component 18 bounds a shape that is configured to reside within the opening 67, without requiring any significant intermeshing of the bristles 46, 58. With this arrangement, with the hair treating apparatus 10 operatively positioned, the bristles 46 project from the second side 16 towards the fourth side 22, with the bristles 58 projecting oppositely from the fourth side 22 to the second side 18. This relationship is maintained with the treating apparatus 10 in its operative position wherein the components 12, 18 have their lengths aligned and the proximal and distal ends 38, 36 are aligned in under-/overlying relationship with the proximal and distal ends 50, 52.

While oppositely projecting bristles 46, 58 are shown, the invention contemplates that bristles might be provided on one of the components 12, 18 and not on the other. It is preferred, however, that the bristles 58 be provided and that they project towards an accumulation of the additive 24 where it is provided at the second side 16. In the depicted construction, the bristles 58 project towards the receptacle 44 with the hair treating apparatus 10 operatively positioned. With this arrangement, the bristles 58 not only control the layout of the hair strands 66, as by straightening, untangling, and tensioning, but also facilitate the even distribution of the additive 24 to the hair strands 66.

As noted above, while the bristles 46, 58 might intermesh, it is preferred that most, if not all, of the bristles 46, 58 are not interengaged. With the depicted embodiment, the bristles 58 will substantially all reside within the opening 67 without contacting the bristles 46. However, due to the flexible nature of the tether 60, there may be some intermeshing of the bristles 46, 58.

Figure 6:
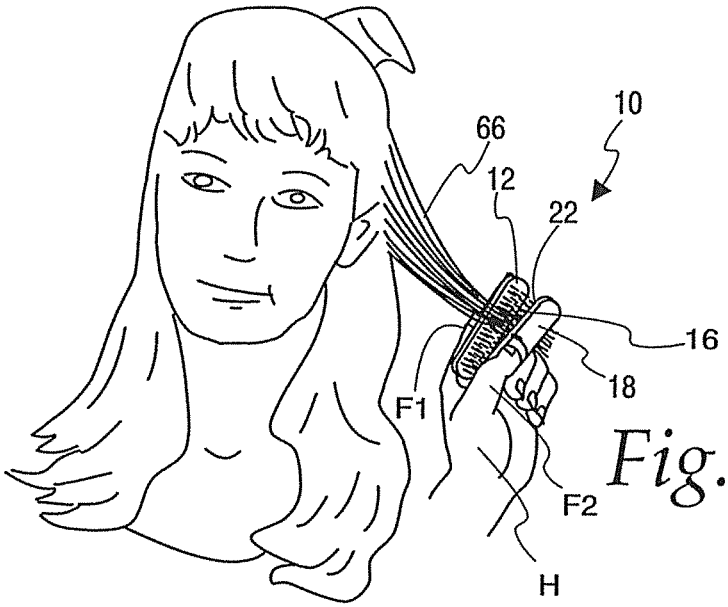
FIG. 6 is a perspective view of the apparatus in FIGS. 2-4 being operatively positioned relative to hair strands on a user's head.
Figure 7:
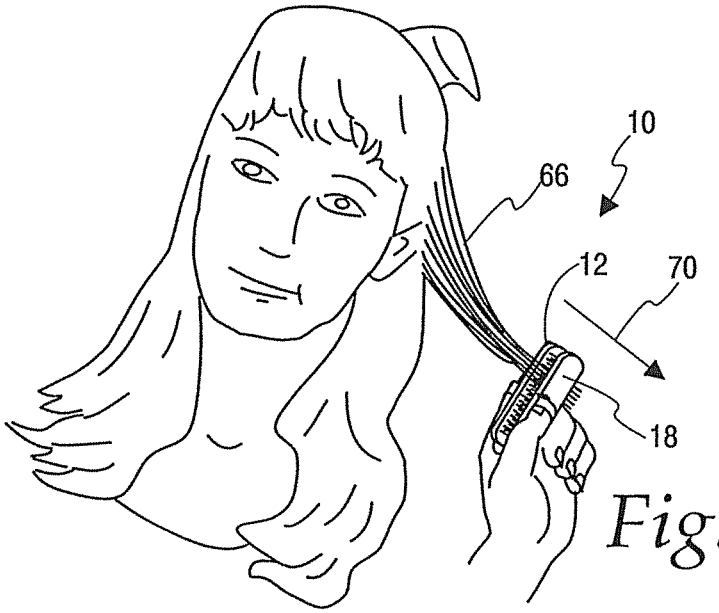
FIG. 7 is a view as in FIG. 6 wherein the operatively positioned apparatus is being drawn along the hair strands to effect treatment thereof.
Figure 8:
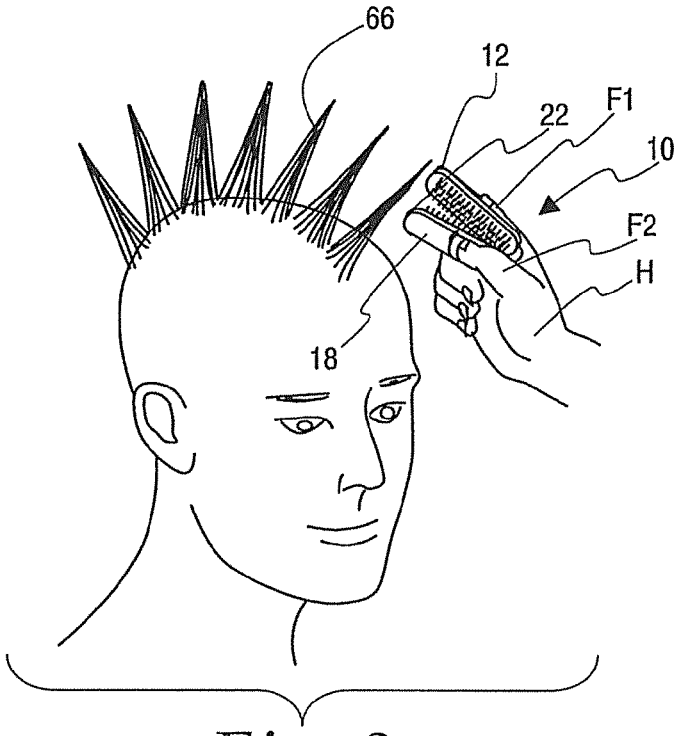
FIGS. 8 and 9 correspond to FIGS. 6 and 7 with the inventive apparatus used to effect treatment of hair "spikes".
Figure 9:
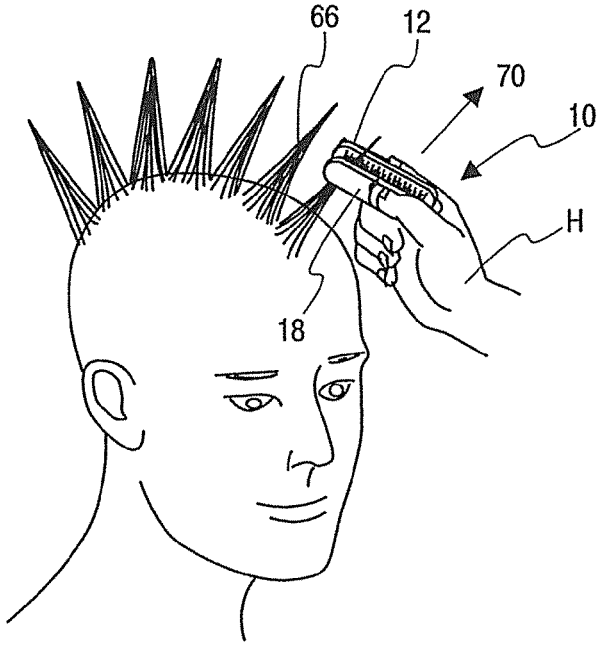

The apparatus 10 can be used as shown clearly in FIGS. 6-9. The apparatus is grasped between the fingers F1, F2 on the user's hand H with the apparatus in an open state, as shown in FIGS. 6 and 8 and in dotted lines in FIG. 4. The fingers F1,F2 operate the components 12, 18 in the same manner that jaws are opened and closed, by selectively moving the fingers F1, F2 away from each other and towards each other.

With the apparatus 10 in an open state, an accumulation of hair strands 66, where treatment is to be affected, can be placed between the sides 16, 22, as shown in FIGS. 6 and 8.

By then moving the fingers F1, F2 towards each other, the sides 16, 22 close against the accumulated hair strands 66, which become exposed to the additive on the side 16. By then drawing the operatively positioned treating apparatus 10 in the direction of the arrow 70 in FIGS. 7 and 9, the apparatus 10 can be drawn along the hair strands 66 to effect combing/brushing thereof, together with the distribution of the additive thereon. The length of the stroke in the line 70 determines the amount of hair length that is treated. By reason of the configuration of the apparatus 10, it is readily usable at the free ends of the hair strands 66 that are relaxed, as in FIGS. 6 and 7, and spiked, as in FIGS. 8 and 9.

Since the components 12, 18 are normally biased away from each other towards an open state for the apparatus 10, release of the squeezing pressure by the fingers F1, F2 allows the components 12, 18 to spring away from each other upon completion of the treatment process. A suitable holding structure 80, as seen in FIG. 4, can be incorporated to maintain the components in a starting open state. This structure is not required, however.

The nature of the bristles 46, 58 is not critical to the present invention. Virtually any material used to form bristles used for combing/brushing hair is contemplated. Plastic bristles have been found to be adequate, whereas other bristles may be more expensive in construction.

The remainder of the components 12, 18 may be made from any material that is generally shape retentive. A harder material allows a thinner construction for each of the components 12, 18. It is preferred that there be sufficient rigidity that the components 12, 18 can be squeezed relatively firmly against the accumulation of hair strands 66 without significant deformation.

Each of the components 12, 18 may be made from one or more parts and one or more different materials. For example, it may be desirable to provide a softer material at the side 16 to allow the bristles 58 to deform a part of the component 16 during the treatment process. This may allow the component 12 to be deformed under the pressure from the bristles 48, which causes a release of additive 24 to be more readily picked up by the hair strands 66.

The foregoing disclosure of specific embodiments is intended to be illustrative of the broad concepts comprehended by the invention.

The invention claimed is:

1. A hair treating apparatus comprising:

a first component having opposite first and second sides, the first side engageable by a first finger on a user's hand, the second side configured to accept an additive to be applied to hair; and a second component having opposite third and fourth sides, the third side engageable by a second finger on the user's hand, the hair treating apparatus operatively positioned with: a) the user's first finger engaging the first side and the user's second finger engaging the third side; and b) an accumulation of elongate hair strands each with a length between the second and fourth sides, whereby the first and second components can be manipulated by movement of the user's first and second fingers at the first and third sides to cause the second and fourth sides to move selectively: i) towards each other to engage the accumulation of hair strands, and ii) away from each other, whereby the operatively positioned hair treating apparatus can be drawn lengthwise of an engaged accumulation of hair strands to thereby controllably apply additive along the lengths of the accumulation of hair strands, wherein there is a plurality of bristles on the fourth side that project toward additive at a location where: a) additive is applied to the second side; and b) there are no bristles on the second side to interact with the bristles on the fourth side with the hair treating apparatus operatively positioned.

2. The hair treating apparatus according to claim 1 wherein the second side has a discrete receptacle for receiving a quantity of additive.

3. The hair treating apparatus according to claim 2 in combination with a quantity of additive in the discrete receptacle, the additive one of: a) a dye; and b) a conditioner.

4. The hair treating apparatus according to claim 1 wherein the first and second components each has a length and width, the length for each component greater than its width, the lengths of the first and second components generally aligned with the hair treating apparatus operatively positioned.

5. The hair treating apparatus according to claim 4 wherein at least one of the components has a receptacle into which a respective one of the user's first and second fingers can be directed by moving the finger generally parallel to the length of the one component.

6. The hair treating apparatus according to claim 5 wherein the receptacle is defined by a strap connected to the one component at spaced locations.

7. The hair treating apparatus according to claim 4 wherein the first component has an oval outer perimeter.

8. The hair treating apparatus according to claim 1 wherein the first and second components are joined by a tether that allows the first and second components to be relatively repositioned so as to move the second and fourth sides selectively towards and away from each other with the hair treating apparatus operatively positioned.

9. The hair treating apparatus according to claim 8 wherein the tether defines a live hinge.

10. The hair treating apparatus according to claim 1 wherein the first and second components have perimeter shapes that are substantially the same.

11. The hair treating apparatus according to claim 1 wherein there is a plurality of bristles on the second side projecting towards the fourth side and the bristles on the second and fourth sides intermesh with each other with the hair treating apparatus operatively positioned.

12. The hair treating apparatus according to claim 1 wherein there is a discrete open receptacle for a quantity of additive on the second side and a plurality of the bristles project towards the receptacle with the hair treating apparatus operatively positioned.

13. A method of treating hair, the method comprising the steps of:

obtaining a hair treating apparatus as in claim 1;

placing an additive on the second side;

engaging the first side with a user's first finger and the third side with a user's second finger;

operatively positioning the hair treating apparatus by moving the first and second fingers to situate an accumulation of elongate hair strands between the second and fourth sides; and with the hair treating apparatus operatively positioned drawing the hair treating apparatus against the accumulation of hair strands to controllably distribute the additive along lengths of the accumulation of hair strands.

14. The method of treating hair according to claim 13 wherein the step of drawing the hair treating apparatus comprises causing the bristles to comb through the accumulation of hair strands.

15. The method of treating hair according to claim 14 wherein there is a plurality of bristles on the second side and further comprising the step of squeezing the first and second components against each other through the first and second fingers to cause bristles on the second and fourth sides to project in opposite directions through the accumulation of hair strands.

16. A hair treating apparatus comprising:

a first component having opposite first and second sides, the first side engageable by a first finger on a user's hand, the second side configured to accept an additive to be applied to hair; and a second component having opposite third and fourth sides, the third side engageable by a second finger on the user's hand, the hair treating apparatus operatively positioned with: a) the user's first finger engaging the first side and the user's second finger engaging the third side; and b) an accumulation of elongate hair strands each with a length between the second and fourth sides, whereby the first and second components can be manipulated by movement of the user's first and second fingers at the first and third sides to cause the second and fourth sides to move selectively: i) towards each other to engage the accumulation of hair strands, and ii) away from each other, whereby the operatively positioned hair treating apparatus can be drawn lengthwise of an engaged accumulation of hair strands to thereby controllably apply additive along the lengths of the accumulation of hair strands, wherein there are bristles on at least one of: a) the second side projecting towards the fourth side; and b) the fourth side projecting towards the second side with the hair treating apparatus operatively positioned, wherein there is a plurality of bristles on the fourth side that project toward additive at a location where additive is applied to the second side with the hair treating apparatus operatively positioned, wherein there is a discrete open receptacle on the second side and a plurality of the bristles project towards the receptacle with the hair treating apparatus operatively positioned, wherein there is a plurality of bristles on the second side projecting toward the fourth side with the hair treating apparatus operatively positioned, wherein the plurality of bristles on the second side are formed into a ring shape around an opening and a majority of the plurality of bristles on the fourth side reside within the opening with the hair treating apparatus operatively positioned.

17. The hair treating apparatus according to claim 16 wherein the ring shape is substantially oval with major and minor axes and the receptacle has an elongate shape with a length aligned with the major axis and resides within the opening.

18. A hair treating apparatus comprising:

a first component having opposite first and second sides, the first side engageable by a first finger on a user's hand, the second side configured to accept an additive to be applied to hair; and a second component having opposite third and fourth sides, the third side engageable by a second finger on the user's hand, the hair treating apparatus operatively positioned with: a) the user's first finger engaging the first side and the user's second finger engaging the third side; and b) an accumulation of elongate hair strands each with a length between the second and fourth sides, whereby the first and second components can be manipulated by movement of the user's first and second fingers at the first and third sides to cause the second and fourth sides to move selectively: i) towards each other to engage the accumulation of hair strands, and ii) away from each other, whereby the operatively positioned hair treating apparatus can be drawn lengthwise of an engaged accumulation of hair strands to thereby controllably apply additive along the lengths of the accumulation of hair strands, wherein there is a plurality of bristles on each of the second and fourth surfaces that project towards each other with the hair treating apparatus operatively positioned, wherein a plurality of the bristles on the second and fourth surfaces intermesh with the hair treating apparatus operatively positioned, wherein the majority of the bristles on the fourth side do not intermesh with bristles on the second side.

* * * * *